United States Patent [19]

Prince

[11] Patent Number: 4,505,317

[45] Date of Patent: Mar. 19, 1985

[54] PRIME MOVER FOR HOT CHAMBER DIE CASTING MACHINES

[75] Inventor: Edgar D. Prince, Holland, Mich.

[73] Assignee: Prince Corporation, Holland, Mich.

[21] Appl. No.: 315,171

[22] Filed: Jan. 7, 1982

[51] Int. Cl.[3] ..... B22D 17/04

[52] U.S. Cl. ..... 164/153

[58] Field of Search ..... 92/134; 164/312, 314, 164/316, 113, 153, 318

[56] References Cited

U.S. PATENT DOCUMENTS

| | | | |
|---|---|---|---|
| 3,248,879 | 5/1966 | Natho | 92/134 |
| 4,174,656 | 11/1979 | Duffey | 92/134 |
| 4,245,690 | 1/1981 | Wälchli | 164/153 |

*Primary Examiner*—Kuang Y. Lin
*Assistant Examiner*—Richard K. Seidel
*Attorney, Agent, or Firm*—Price, Heneveld, Huizenga & Cooper

[57] ABSTRACT

A prime mover for hot chamber die casting machines and the like, comprises a cylindrical housing with a piston slidably mounted therein for translation between extended and retracted positions. A rod connects the piston with an injection plunger portion of the casting machine. A closed reservoir, retaining high pressure gas therein, communicates with the power side of the piston, and urges the same toward the extended position. The piston is translated to the retracted position, and selectively released, whereby the high pressure gas contained in the reservoir quickly accelerates the piston to a fast speed portion of the shot stroke, and also facilitates substantially instantaneous deceleration of the piston at the end of the shot stroke without substantial backlash.

22 Claims, 6 Drawing Figures

PRIME MOVER FOR HOT CHAMBER DIE CASTING MACHINES

BACKGROUND OF THE INVENTION

The present invention relates to die casting machines, and in particular to a prime mover for hot chamber die casting processes and the like.

At least two different types of die casting machines are presently being used in industry. A first type of die casting machine is referred to as a "cold chamber" machine, and comprises a molten metal reservoir, which is separated from the casting machine, and wherein just enough metal for one casting is ladled by hand into a small chamber, from which it is forced into the die under high pressure. Cold chamber casting machines are generally used in forming aluminum, brass, magnesium, and related alloys. A second type of die casting machine is referred to as a "hot chamber" casting machine, and comprises a basin holding molten metal, a metallic mold or die, and a metal-transferring device which automatically withdraws molten metal from the basin and forces it under pressure into the die. Hot chamber casting machines are typically used in forming zinc, and various zinc alloys.

In one class of hot chamber die casting machines, a plunger is mounted in the basin in which molten metal is retained and is reciprocated by a motor or prime mover to inject the die cavity with molten metal. Typically, the prime mover for the plunger comprises a hydraulic cylinder connected by long hydraulic supply lines with an accumulator that provides a source of high pressure hydraulic fluid. The stroke of the plunger, generally referred to as the "shot stroke," is relatively short in comparison to cold chamber die casting machines, and commences rather slowly past an inlet port for the molten metal, and then accelerates rapidly to a very high speed until the die cavity is completely filled, at which time the back pressure of the injected molten metal suddenly stops extension of the injection plunger.

When a hydraulic cylinder is used as the prime mover for the plunger, the inherent mass and momentum of the hydraulic fluid create problems in properly injecting the die cavity. These problems are particularly prevalent at the beginning and at the end of the shot stroke, when the hydraulic fluid in the prime mover cylinder must be quickly accelerated and decelerated. In accelerating the plunger, a portion of the driving force must be expended to accelerate the hydraulic fluid in the prime mover, and also overcome the frictional forces created by the speed and viscosity of the hydraulic fluid. The frictional losses associated with the fast flowing hydraulic fluid increase dramatically when the plunger is accelerated to the high speed portion of the shot stroke, as the Reynolds number associated with the flow increases exponentially in the range of turbulent flow. The long hydraulic supply lines which are usually required to connect the accumulator with the prime mover exacerbate these problems, and result in severe pressure differentials along the hydraulic lines.

When the piston is decelerated, the kinetic energy of the hydraulic fluid must be quickly dissipated, or the hydraulic fluid will exert an impact force on the injection plunger, which will cause the die to spit. Further, this type of impact force on the injection plunger will cause the plunger to bounce or rebound back from the bottom dead center position, which creates a recoil or backlash, comprising a negative velocity spike that results in the formation of cavities in the casting and ruins their integrity. A hydraulic hammering effect can also be experienced due to the celerity of the resulting impact wave relative to the velocity of hydraulic fluid in the prime mover system.

SUMMARY OF THE INVENTION

One aspect of the present invention is to provide a gas powered prime mover for hot chamber die casting machines and the like, which comprises a cylinder housing, and a piston slidably mounted therein with a rod for manipulating an injection plunger portion of the shot cylinder. A closed reservoir retains high pressure gas therein, and communicates with the power side of the piston for urging the same toward the extended position. A mechanism is provided for returning the piston to the retracted position, and a lock selectively retains the piston in the fully retracted position. When the piston is released, the high pressure gas contained in the reservoir quickly accelerates the piston to a fast speed portion of the shot stroke. The low density gas facilitates substantially instantaneous deceleration of the piston at the time of die cavity fill without substantial impact, backlash or other similar undesirable effects.

The principal objects of the present invention are to provide a prime mover for hot chamber die casting machines, which employ a low density driving fluid, so as to reduce the amount of energy required to accelerate the fluid, and the amount of effort required to dissipate the kinetic energy of the moving fluid. The present invention alleviates hydraulic hammering or impact at the end of the shot stroke, as well as the associated plunger recoil or rebound, thereby providing a more efficient, safe operation that produces high integrity castings. The present prime mover eliminates the high pressure hydraulic accumulator, as well as the long hydraulic fluid supply lines, which inherently produce substantial frictional losses, harmful pressure spikes, and other related inefficiencies and problems. The gas powered prime mover has an uncomplicated construction that is particularly well adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
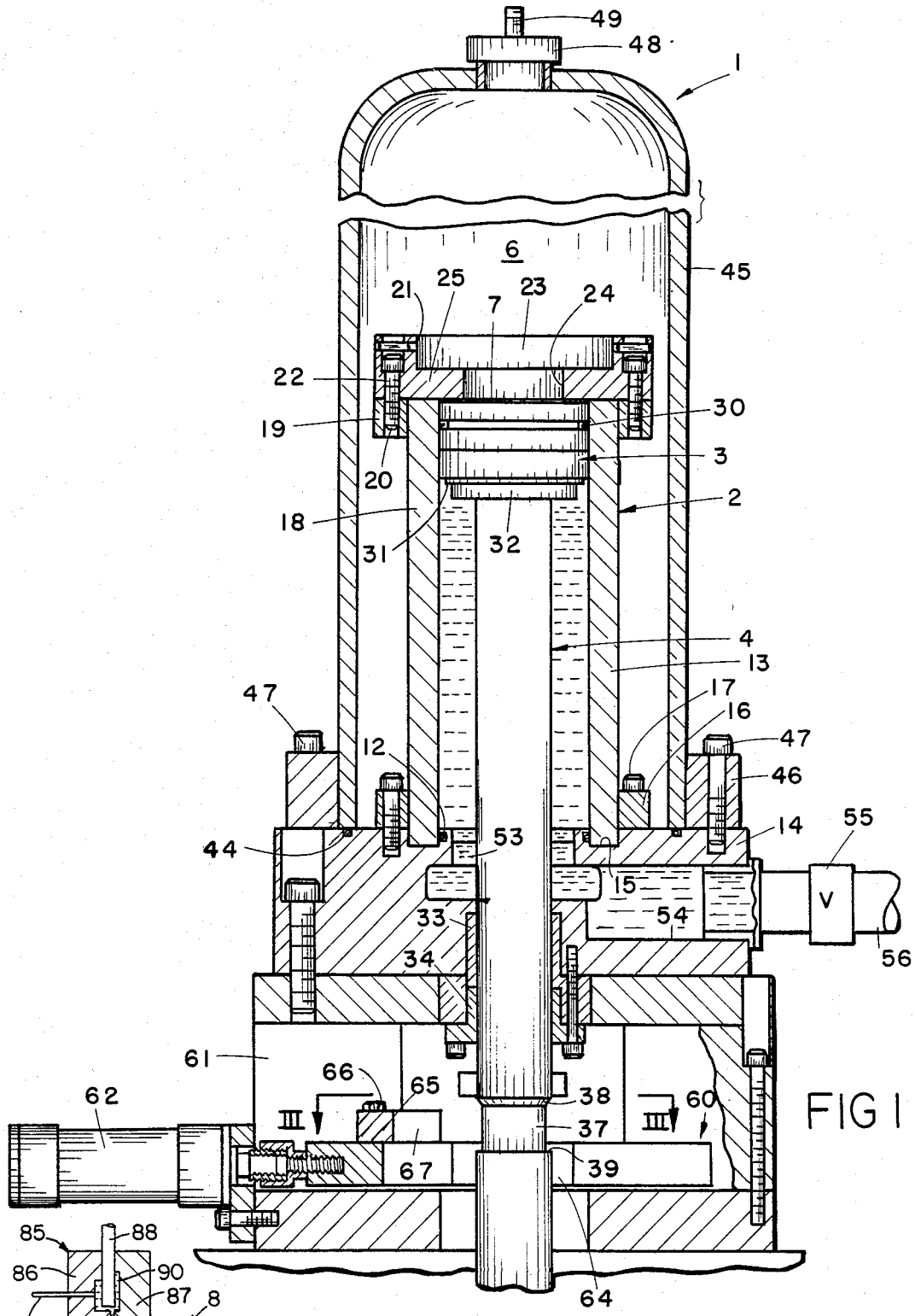
FIG. 1 is a vertical cross-sectional view of a prime mover embodying the present invention.

For purposes of description herein, the terms "upper," "lower," "right," "left," "rear," "front," "vertical," "horizontal" and derivatives thereof shall relate to the invention as oriented vertically in FIG. 1. However, it is to be understood that the invention may assume various alternative orientations, except where expressly specified to the contrary.

The reference numeral 1 (FIG. 1) generally designates a prime mover for hot chamber die casting machines and the like, which embodies the present invention. Prime mover 1 comprises a cylinder housing 2 with a piston 3 slidably mounted therein for translation between extended and retracted positions. A rod 4 connects piston 3 with an injection plunger portion 5 of the shot cylinder. A closed reservoir 6, retaining high pressure gas therein, communicates with the power side 7 of piston 3, and urges the piston toward the extended position. Piston 3 is translated to the retracted position, and selectively released therefrom, whereby the high pressure gas contained in reservoir 6 quickly accelerates injection plunger 5 to a fast speed portion of the shot stroke, and also facilitates substantially instantaneous deceleration of injection plunger 5 at the end of the shot stroke without substantial rebound or backlash.

Figure 2:
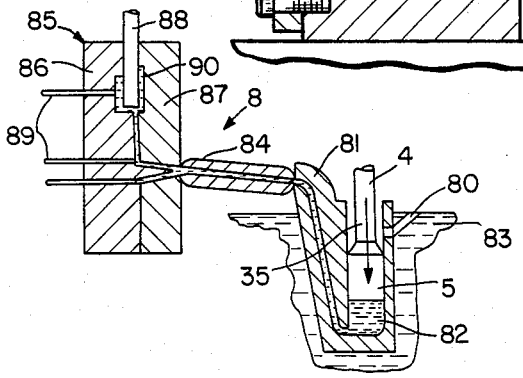
FIG. 2 is a partially schematic, cross-sectional view of a hot chamber die casting machine on which the prime mover shown in FIG. 1 is adapted to be used.

Prime mover 1 is particularly adapted for use in conjunction with a conventional hot chamber die casting machine 8, as schematically illustrated in FIG. 2. Casting machine 8 comprises a basin 83 for retaining molten metal therein, and a hot chamber 81 with a cylindrical bore 82 in which plunger 5 is slidingly received. An inlet port 80 communicates cylindrical bore 82 with basin 83, and a gooseneck 84 transmits injected molten metal into a die 85, comprising mating halves 86 and 87, and a core 88. Ejector pins 89 are mounted in die half 86 to push the formed casting out of the die cavity 90.

When plunger 5 is extended, molten metal is injected into die cavity 90. When plunger 5 is retracted, a new charge of molten metal is drawn into hot chamber bore 82 through inlet port 80 for the next die injection.

In the illustrated example, cylinder housing 2 comprises a hollow, cylindrically-shaped structure, having a smooth, inner bore in which piston 3 is slidably received. The lower or base end 13 of housing 2 is attached to a mounting block 14, and in this example, is closely received in a mating annular groove or slot 15 in the upper surface of mounting block 14. A fastener ring 16 is attached to the base end 13 of housing 2, and includes a plurality of circumferentially spaced apart apertures through which fastener 17 extends to attach housing 2 to mounting block 14. An O-ring 12 extends around the inner surface of housing base 13 to form a seal with mounting block 14. The outer end 18 of housing 3 also includes an annularly-shaped fastener ring 19 fixedly attached thereto, with a plurality of circumferentially spaced apart, tapped apertures 20. An annularly-shaped end cap or stop 21 is attached to the upper end of cylinder housing 2 by fasteners 22, which are matingly received in the apertures 20 of ring 19. Stop 21 includes a pair of disc-shaped apertures 23 and 24, which communicate reservoir 6 with the power slide 7 of piston 3, and a shoulder 25, which extends radially inwardly of the rim of housing 2 for abutment with the power side 7 of piston 3 to positively locate the same in the retracted position, as discussed in greater detail below. The apertures 23 and 24 in stop 21 are shaped so that they present no substantial resistance or restriction to gas flowing into cylinder 2.

Piston 3 includes a ring-shaped seal 30, which is received in a mating groove in the periphery of piston 3, and abuttingly seals against the interior surface of cylinder housing 2. In this example, seal 30 comprises an elastomer ring having a substantially rectangular transverse cross-sectional shape. The rod side 31 of piston 3 includes a collar 32 to which rod 4 is fixedly attached. Rod 4 is positioned coaxially with respect to piston 3, and extends through a pair of seals 33 and 34 mounted in block 14. The lower end 35 of rod 4 is attached to the shot cylinder injection plunger 5 in a conventional fashion. A medial portion of rod 4 includes an annular recess or groove 37 defined between edges 38 and 39, which is adapted to provide a safety lock for the prime mover, as described in greater detail hereinafter.

Gas reservoir 6 is formed by a dome or bell-shaped housing 45, having a connector ring 46 attached to the lower end thereof, with circumferentially spaced apertures, through which fasteners 47 extend to attach the housing to mounting block 14. An O-ring 44 is mounted in the top surface of block 14, and abuttingly mates with the lower edge of dome 45 to form an airtight seal therebetween. Reservoir 6 has a volume sized sufficiently large with respect to the volume displaced during the stroke of piston 3, that the force acting on the power side 7 of piston 3 is substantially constant throughout the shot stroke. In this example, the ratio of the reservoir volume to the displacement volume of piston 3 is in the range of 10:1 to 20:1. Dome 45 preferably includes means for recharging reservoir 6 with a high pressure gas, and in this example, includes a fitting 48 at the upper end of the dome with a valve 49.

Reservoir 6 is adapted to retain a high pressure gas therein, which is preferably diatomic nitrogen, having a pressure of approximately 900 psig when piston 3 is fully extended, and 1000 psig when piston 3 is fully retracted. As will be readily apparent to one having ordinary skill in the art, the size of piston 3 can be varied, as well as the pressure of the gas in reservoir 6 to vary the maximum injection force of prime mover 1.

A hydraulic system is disposed on the exhaust or rod side 31 of piston 3 to control the movement of piston 3. In the illustrated structure, the upper surface of mounting block 14 includes an annular aperture 53 disposed about piston rod 4, and communicating with the rod side of cylinder housing 2. A port 54 extends laterally through block 14, substantially perpendicular with rod 4, and communicates aperture 53 with a variable hydraulic valve 55 mounted in conduit 56. A conventional source of high pressure hydraulic fluid, such as a pump (not shown) is also connected with conduit 56, and selectively supplies high pressure hydraulic fluid to the system to move piston 3 to the fully retracted position, as illustrated in FIG. 1, and is described more fully hereinbelow.

Valve 55 is designed to control the flow of hydraulic fluid exiting from the return side of cylinder housing 2, such as a cartridge valve or the like, and may even be in the nature of a binary control valve, as disclosed in assignee's copending U.S. patent application Ser. No. 256,956, filed Apr. 23, 1981, now U.S. Pat. No. 4,460,324, entitled SHOT CYLINDER CONTROLLER FOR DIE CASTING MACHINES AND THE LIKE, which is hereby incorporated by reference.

Figure 6:
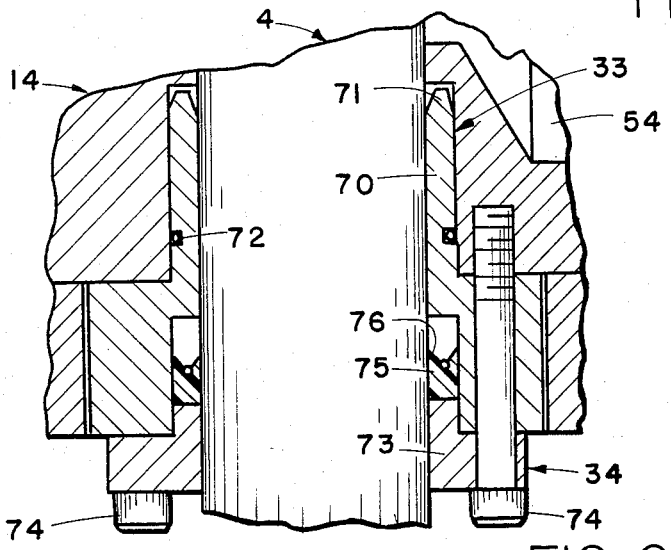
FIG. 6 is an enlarged, fragmentary, cross-sectional view, particularly showing a rod seal portion of the prime mover.

An end bearing 33 supports the lower end of rod 4, and a seal 34 prevents leakage of hydraulic fluid about rod 4 from the rod side of the cylinder. As best illustrated in FIG. 6, bearing 33 comprises a sleeve 70, with a tapered upper end 71, and an exterior groove in which an O-ring 72 is mounted. The lower end of bearing 33 is hollow, and has a gland 34 mounted therein. Gland 34 comprises a rigid collar 73 with fasteners 74 extending through mating apertures to attach both bearing 33 and seal 34 to the lower end of block 14. Resilient packing 75 with a V-shaped upper surface 76 is retained in the hollow end of sleeve 33 by the upper end of collar 73.

Figure 3:
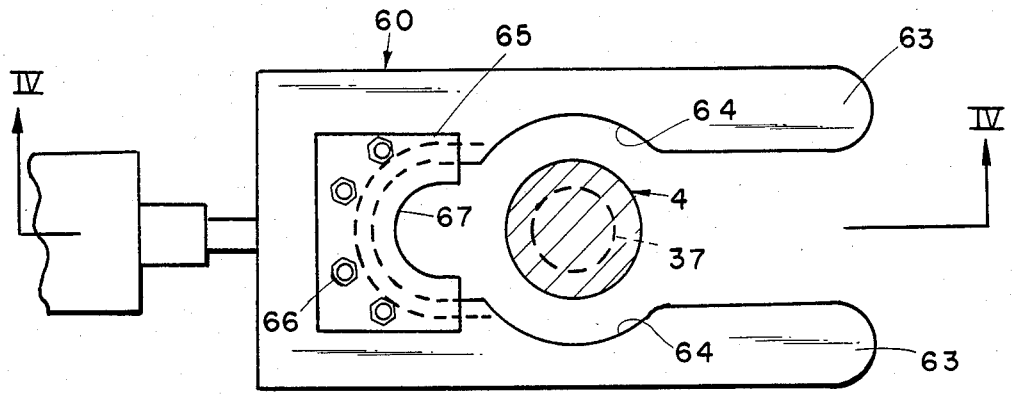
FIG. 3 is an enlarged fragmentary, horizontal cross-sectional view of the prime mover, taken along the line III—III, FIG. 1, particularly showing a safety stop in an unlocked position.
Figure 4:
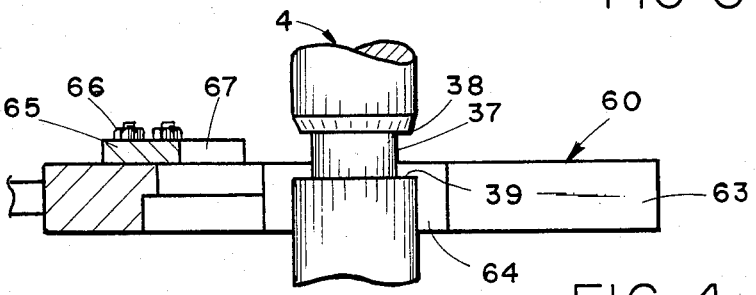
FIG. 4 is a cross-sectional view of the prime mover stop, taken along the line IV—IV, FIG. 3, and shown in an unlocked position.
Figure 5:
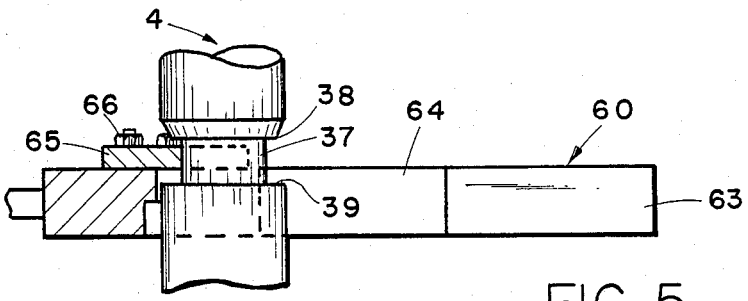
FIG. 5 is a cross-sectional view of the prime mover stop, shown in a locked position.

A safety stop arrangement is provided to insure that piston 3 cannot be inadvertently released from the fully retracted position, and comprises a safety bar or yoke 60 which is slidably mounted in a hollow portion 61 of mounting block 14, and reciprocated therein by a suitable lineal motor, such as cylinder 62. As best illustrated in FIGS. 3–5, yoke 60 comprises a pair of fingers or prongs 63, each having an arcuate indentation 64 along the interior side thereof which is positioned in a concentric relationship with piston rod 4 during an unlocked position. A stop plate 65 is attached to the upper surface of yoke 60 by fasteners 66, and includes a semicircular notch 67 therethrough which is shaped to mate with the recess 37 in piston rod 4, as shown in FIG. 4.

In operation, reservoir 6 is filled with high pressure gas, selected in accordance with the specific application. The gas in reservoir 6 will normally require periodic recharging through valve 49 to insure proper operating pressure.

Valve 55 is then shifted so as to communicate high pressure hydraulic fluid from the supply pump (not shown) with the rod side 31 of piston 3. The force exerted by the pressurized hydraulic fluid on the rod side of piston 3 is sufficient to overcome the force of the pressurized gas acting on the power side 7 of piston 3, and therefore translates the piston upwardly. As piston 3 is retracted, the effective volume of reservoir 6 in which the gas is retained is reduced, thereby further compressing the gas, and exerting a corresponding force on the power side 7 of piston 3. As piston 3 approaches the open end of cylinder 2, the piston abuts shoulder 25 to positively stop the same in the fully retracted position. Valve 55 is then closed, thereby retaining piston 3 in an energized or cocked position. To insure that piston 3 does not inadvertently extend, such as from a leak in the hydraulic system, yoke 60 is shifted to the right (as viewed in FIG. 1) so that stop plate 65 engages rod recess 37, as illustrated in FIG. 5, thereby positively preventing piston 3 from extending.

When die injection is desired, the operator shifts yoke 60 to the unlocked position, as shown in FIG. 1, and selectively operates valve 55, thereby permitting the hydraulic fluid on the rod side of piston 3 to be exhausted into a conventional low pressure sump or manifold. When valve 55 is opened, piston 3 is unlocked from the fully retracted position, and the high pressure gas contained in reservoir 6 exerts a driving force on the power side 7 of the piston that initiates the movement of piston 3. Normally, the flow of hydraulic fluid through valve 55 is controlled in a manner such that the high pressure gas contained in reservoir 6 quickly accelerates piston 3 to a fast speed portion of the shot stroke. Since the mass and viscosity of the gas are relatively low, as compared to fluids, very fast acceleration can be achieved. At the end of the shot stroke, when the die cavity 90 is completely filled, the back pressure exerted by the molten metal in cylindrical bore 82 quickly halts the extension of plunger 5 and piston 3. Since the mass of the gas is much less than that of a fluid, there is much less momentum or kinetic energy in the driving fluid which must be dissipated, thereby greatly alleviating any impact, rebound, or backlash which is normally experienced at the end of the shot stroke. Since the expanding gas in reservoir 6 is compressible, it also serves to absorb or dampen any impact on piston 3. Prime mover 1 eliminates the need for an accumulator and the associated hydraulic supply lines, thereby greatly reducing frictional losses, pressure spikes, and hydraulic hammering.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In combination with a hot chamber die casting machine of the type having a hot chamber positioned in a basin of molten metal, an inlet port in said hot chamber through which molten metal flows from said basin into said hot chamber, a gooseneck between said hot chamber and a die cavity, and a shot cylinder and plunger mounted within said hot chamber which, through a controlled extension stroke, selectively injects a molten metal from within said hot chamber into said die cavity; an improved prime mover for reciprocating said shot cylinder plunger, comprising:

a cylindrically shaped housing mounted adjacent to said hot chamber;

a piston slideably mounted in said housing, and having a power side and a return side; a rod having one end connected with the return side of said piston and the other end operably connected with said shot cylinder plunger for cyclically and selectively moving said shot cylinder between extended and retracted positions between which a shot stroke is defined;

a closed reservoir retaining high pressure gas therein; said reservoir communicating with the power side of said piston for urging the same toward the extended position, and having a volume sized sufficiently large with respect to the volume displaced by said piston during the shot stroke that the force acting on the power side of said piston is substantially constant throughout the shot stroke to accurately control the injection of said die cavity;

means for returning said piston to the retracted position after injection of molten metal into said die cavity;

means for selectively retaining said piston in the retracted position while molten metal flows from said basin into said hot chamber to recharge said shot cylinder; and means for releasing said piston retaining means after said shot cylinder is filled with molten metal, whereby the high pressure gas contained in said reservoir quickly accelerates said piston to a fast speed portion of the shot stroke, and also facilitates substantially instantaneous deceleration of said piston at the end of the shot stroke without substantial backlash.

2. A hot chamber die casting machine as set forth in claim 1, including:

means for controlling the speed at which said piston extends.

3. A hot chamber die casting machine as set forth in claim 1, wherein:

said piston returning means, said piston retaining means, and said piston releasing means comprise a hydraulic system acting on the return side of said piston.

4. A hot chamber die casting machine as set forth in claim 3, wherein said hydraulic system comprises:

means for selectively introducing high pressure hydraulic fluid into said cylinder housing through a port on the return side of said piston; and a valve connected with said port and controlling the flow of hydraulic fluid therethrough.

5. A hot chamber die casting machine as set forth in claim 4, wherein:

said valve comprises a cartridge valve which controls the flow of hydraulic fluid exiting from the return side of said cylinder housing, and in conjunction with said high pressure gas, quickly accelerates said piston to a fast speed at the beginning of the shot stroke and then progressively deaccelerates said piston to a slower speed toward the end of the shot stroke.

6. A hot chamber die casting machine as set forth in claim 5, wherein:

said reservoir is positioned about said cylinder housing.

7. A hot chamber die casting machine as set forth in claim 7, wherein:

said cylinder housing includes an open end through which the power side of said piston is communicated with said reservoir.

8. A hot chamber die casting machine as set forth in claim 7, wherein:

said piston rod is coaxial with said injection plunger.

9. A hot chamber die casting machine as set forth in claim 8, wherein:

said prot is oriented substantially perpendicular to said piston rod.

10. A hot chamber die casting machine as set forth in claim 9, including:

a safety bar shaped to engage said piston in a locked position and to positively prevent said piston from inadvertently moving from the retracted position; and means for shifting said safety bar between the locked position and an unlocked position.

11. A hot chamber die casting machine as set forth in claim 10, wherein:

said safety bar includes a yoke shaped to selectively engage a mating shoulder on said piston rod.

12. A hot chamber die casting machine as set forth in claim 11, wherein:

said reservoir includes means for recharging the same with high pressure gas.

13. A hot chamber die casting machine as set forth in claim 12, wherein:

said reservoir is defined by a dome-shaped housing in which said cylinder housing is mounted in an axially aligned relationship.

14. A hot chamber die casting machine as set forth in claim 13, wherein:

said cylinder housing includes a stop at the open end thereof which abuts the power side of said piston to positively locate said piston in the retracted position.

15. A hot chamber die casting machine as set forth in claim 1, wherein:

said reservoir is positioned about said cylinder housing.

16. A hot chamber die casting machine as set forth in claim 1, wherein:

said cylinder housing includes an open end through which the power side of said piston is communicated with said reservoir.

17. A hot chamber die casting machine as set forth in claim 16, wherein;

said cylinder housing includes a stop at the open end thereof which abuts the power side of said piston to positively locate said piston in the retracted position.

18. A hot chamber die casting machine as set forth in claim 1, wherein:

said piston rod is coaxial with said injection plunger.

19. A hot chamber die casting machine as set forth in claim 1, including:

a safety bar shaped to engage said piston in a locked position and to positively prevent said piston from inadvertently moving from the retracted position; and means for shifting said safety bar between the locked position and an unlocked position.

20. A hot chamber die casting machine as set forth in claim 19, wherein:

said safety bar includes a yoke shaped to selectively engage a mating shoulder on said piston rod.

21. A hot chamber die casting machine as set forth in claim 1, wherein:

said reservoir includes means for recharging the same with high pressure gas.

22. A hot chamber die casting machine as set forth in claim 1, wherein:

said reservoir is defined by a dome-shaped housing in which said cylinder housing is mounted in an axially aligned relationship.

* * * * *

UNITED STATES PATENT AND TRADEMARK OFFICE

CERTIFICATE OF CORRECTION

PATENT NO. : 4,505,317

DATED : March 19, 1985

INVENTOR(S) : Edgar D. Prince

It is certified that error appears in the above-identified patent and that said Letters Patent is hereby corrected as shown below:

Column 1, line 43:
insert --certain-- after "create";

Column 3, line 63:
"slide" should be --side--;

Column 6, line 35:
"slideably" should be --slidably--

Column 7, line 24:
"deaccelerates" should be --decelerates--;

Column 7, line 32, Claim 7:
"7" should be --6--

UNITED STATES PATENT AND TRADEMARK OFFICE

CERTIFICATE OF CORRECTION

PATENT NO. : 4,505,317

DATED : March 19, 1985

INVENTOR(S) : Edgar D. Prince

It is certified that error appears in the above-identified patent and that said Letters Patent is hereby corrected as shown below:

Column 7, line 41, Claim 9:
"prot" should be --port--;

Column 8, line 26, Claim 17:
"wherein;" should be --wherein:--

Signed and Sealed this

*Fourth* Day of *February 1986*

[SEAL]

*Attest:*

*Attesting Officer*

DONALD J. QUIGG

*Commissioner of Patents and Trademarks*